United States Patent [19]

Elchisak et al.

[11] Patent Number: 5,052,600

[45] Date of Patent: Oct. 1, 1991

[54] ROD COUPLING RECEPTACLE FOR GARMENT HANGERS

[75] Inventors: Michael Elchisak, Shenandoah, Pa.; Steven Z. Lewkowitz, Woodbridge Kings Mountain, N.C.

[73] Assignee: A & E Products Group, a Division of Carlisle Plastics, Inc., Woodbridge, N.J.

[21] Appl. No.: 609,566

[22] Filed: Nov. 6, 1990

[51] Int. Cl.[5] ..... A47G 25/16; A47G 25/14; A47G 25/48

[52] U.S. Cl. ..... 223/96; 223/95; 223/92; 223/85; 223/88

[58] Field of Search ..... 223/95, 96, 85, 92, 223/93, 88, 90, 91; D6/315, 328, 325, 326; 206/278, 298; 403/353, 375; 211/105.1; 248/251, 221.3

[56] References Cited

U.S. PATENT DOCUMENTS

| | | | |
|---|---|---|---|
| 2,372,458 | 3/1945 | Tewell | 223/88 |
| 3,537,626 | 11/1970 | Wright | 223/95 |
| 3,730,406 | 5/1973 | Sullivan | 223/95 |
| 4,446,996 | 5/1984 | Garrison | 223/96 |
| 4,638,930 | 1/1987 | Blanchard | 223/96 X |
| 4,793,531 | 12/1988 | Blanchard et al. | 223/95 |

*Primary Examiner*—Werner H. Schroeder
*Assistant Examiner*—Bibhu Mohanty
*Attorney, Agent, or Firm*—Blum Kaplan

[57] ABSTRACT

A garment hanger adapted to support an elongated rod. The hanger includes an elongated body having two ends and a hook portion therebetween. The ends of the body extend downwardly to form a pair of spaced legs each having a rod receiving portion, with each rod receiving portion being defined by a bottom wall, a back wall joined to the bottom wall and forming part of the body and an upstanding resilient tongue joined to the bottom wall and spaced a predetermined distance from the back wall to define a rod receiving slot. The back wall includes an opening therein in alignment with the tongue defined by the bottom wall, top wall and opposing side walls, the surfaces of the side walls facing the tongue each having an undercut for capturing the rod when inserted in the slot. The tongue biases the rod in the slot against the undercuts to lock the rod in the rod receiving portions.

4 Claims, 2 Drawing Sheets

ROD COUPLING RECEPTACLE FOR GARMENT HANGERS

BACKGROUND OF THE INVENTION

The present invention is directed to a plastic garment hanger having means for supporting a clip-holding metal rod and, in particular, to an improved rod coupling construction for plastic garment hangers.

Plastic garment hangers having a body portion which supports a metal rod having slidable clips thereon are well-known in the art. Such garment hangers include a plastic body portion having a centrally located hook for suspending the hanger from a support rod. Such hangers further include two depending legs which support a laterally extending metal rod on which one or more plastic or metal clips are coupled. The clips are used to capture and releaseably hold garments or other articles between the jaws of the clips.

In one prior art construction, the metal rod is fixed in lateral slots formed in the body of the garment hanger during the molding process. The rod is actually inserted in the mold and the legs of the hanger are molded around the rod to make an essentially permanent coupling. In another prior art construction, the rod is inserted in lateral side openings in the hanger legs after molding of the hanger.

An attempt to improve on the construction of a rod receiving garment hanger is found in U.S. Pat. No. 4,638,930 which issued on Jan. 27, 1987. This patent discloses a garment hanger with depending legs each having a rod receiving pocket defined by a curved lower wall and a downwardly depending resilient tongue which locks the rod in the pocket as the tongue presses downwardly on the rod. If the molding tolerances are not correct, the locking tongue in such construction can fail to operate properly to lock the rod in the pocket.

Accordingly, it is desired to provide an improved rod coupling construction for garment hangers which overcomes the disadvantages noted above with respect to the prior art while permitting the rod to be inserted after molding of the garment hanger.

SUMMARY OF THE INVENTION

Generally speaking, in accordance with the present invention, a garment hanger adapted to support an elongated rod is provided. The garment hanger includes an elongated body having two ends and a hook portion therebetween. The ends of the body extend downwardly to form a pair of spaced legs each having a rod receiving portion. Each rod receiving portion of the legs is defined by a bottom wall, a back wall joined to the bottom wall and forming part of the body, and an upstanding resilient tongue joined to the bottom wall and spaced a predetermined distance from the back wall to define a rod receiving slot. The back wall includes an opening therein in alignment with the tongue defined by the bottom wall, a top wall and opposing side walls. The surfaces of the side walls facing the tongue each have an undercut for capturing the rod when inserted in the slot. The tongue biases the rod in the slot against the undercuts to lock the rod and the rod receiving portions.

In a preferred embodiment, the upper edge of the tongue includes an inside surface facing the back wall which is inclined downwardly towards the back wall for directing the rod into the rod receiving slots.

Accordingly, it is an object of the present invention to provide an improved rod coupling construction for garment hangers.

Another object of the present invention is to provide a plastic garment hanger having two depending legs on which a metal rod can be supported after molding of the hanger.

A further object of the present invention is to provide specially designed rod receiving slots in the legs of a plastic garment hanger which permit a metal rod to be readily inserted therein.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
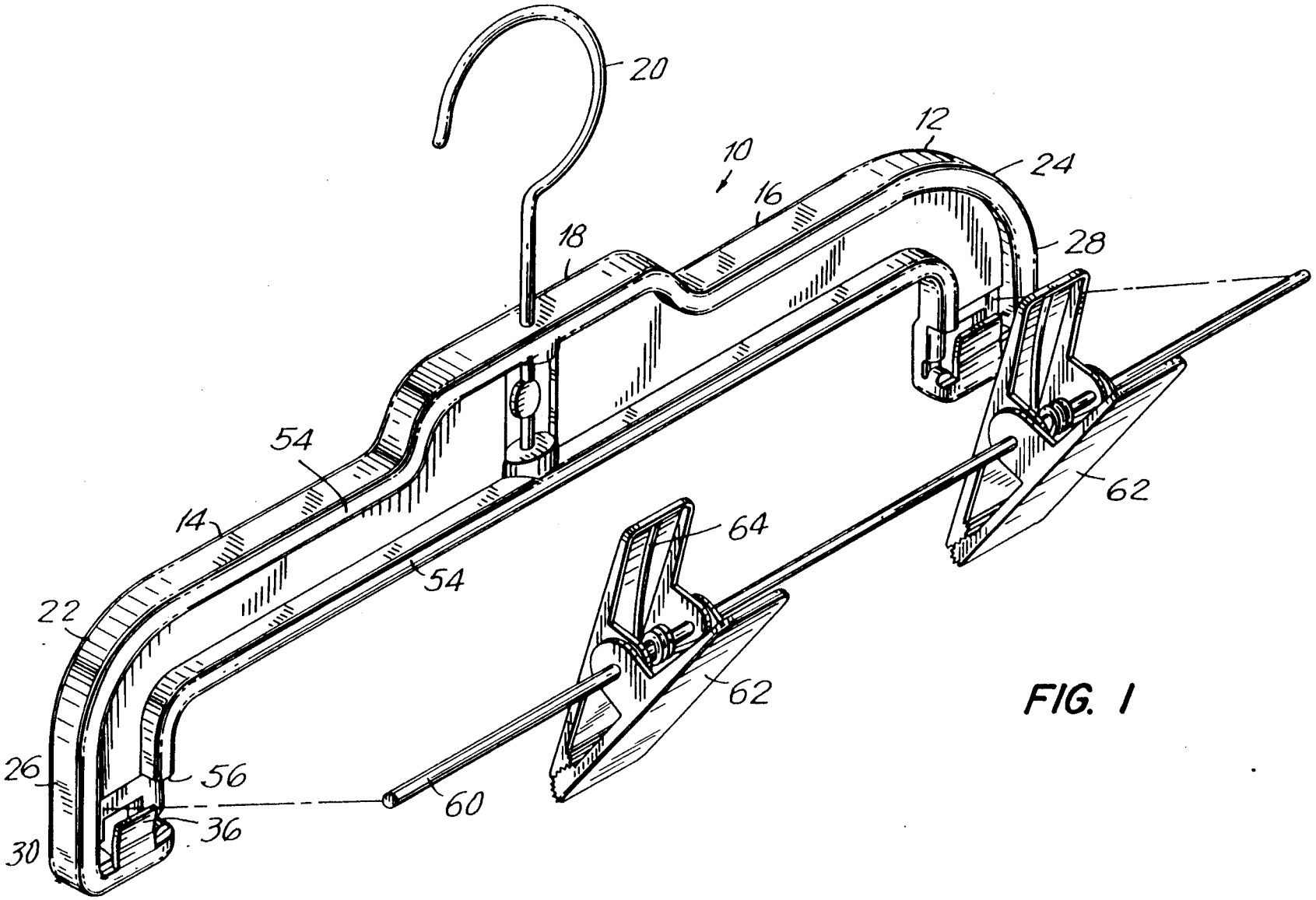
FIG. 1 is a perspective exploded view of a garment hanger having a rod coupling construction in accordance with a preferred embodiment of the present invention.

Reference is made to FIGS. 1 through 4 in the present application which depict a garment hanger, generally indicated at 10, and constructed in accordance with a preferred embodiment of the present invention. Hanger 10 includes a body portion 12 preferably molded from a thermoplastic material having arms 14 and 16 which extend respectively outwardly from a centrally located neck portion 18. Neck portion 18 supports a conventional metal hook 20 which is used to support garment hanger 10 from a support rod, hook or the like.

Each arm 14 and 16 terminates laterally in a respective rounded shoulder 22 and 24 which turn downwardly to a respective first leg 26 and second leg 28 Since both legs 26 and 28 are similarly constructed, only the details of construction of leg 26 will hereinafter be described.

Leg 26 includes a rod receiving portion 30 defined by a bottom wall 32, a back wall 34 joined to bottom wall 32 and forming a part of body 12 and an upstanding resilient tongue 36 joined to bottom wall 32. Upstanding resilient tongue 36 is spaced a predetermined distance from back wall 34 to provide sufficient clearance for a rod 50 to be inserted therein while pressing there against so as to define a rod receiving slot 40.

Figure 3:
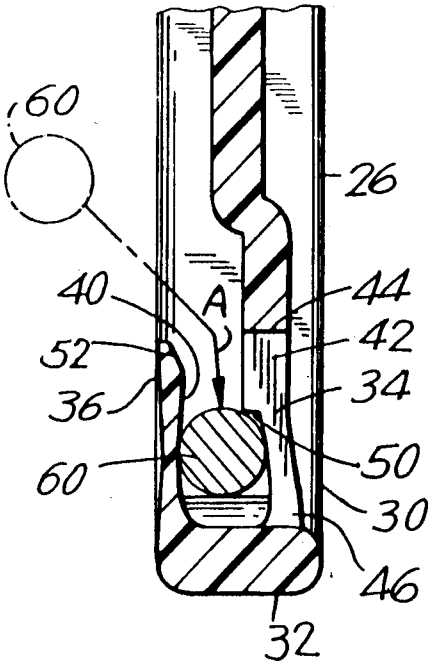
FIG. 3 is an enlarged sectional view taken along line 3—3 of FIG. 2.
Figure 4:
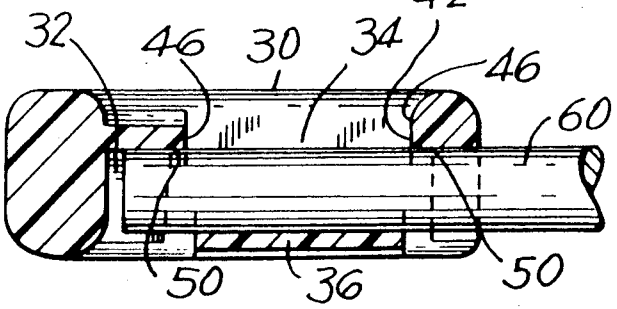
FIG. 4 is an enlarged sectional view taken along line 4—4 of FIG. 2.
Figure 2:
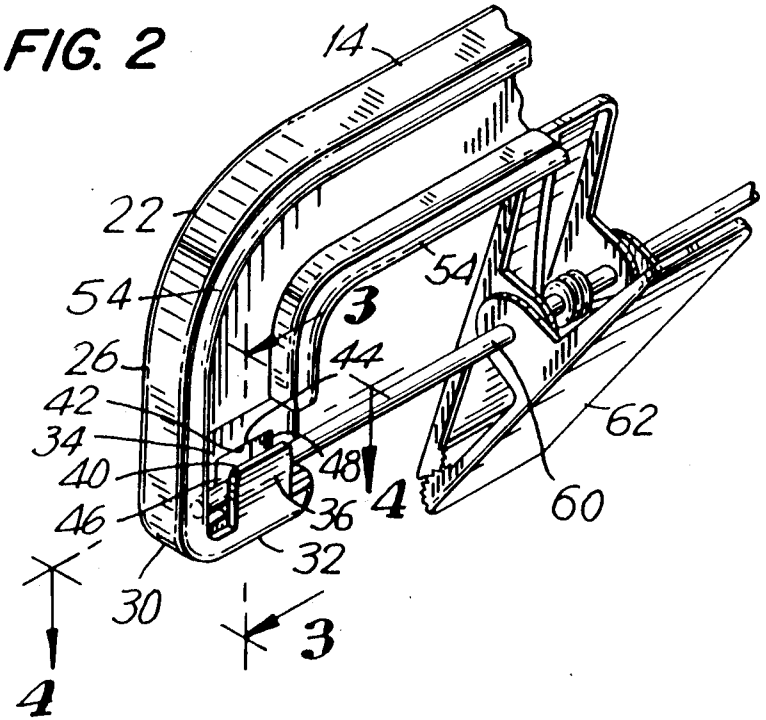
FIG. 2 is a partial perspective view of one of the hanger legs depicted in FIG. 1, shown with the metal rod in place.

Back wall 34 includes an opening 42 therein in alignment with resilient tongue 36. Opening 42 in back wall 34 is defined by bottom wall 32, top wall 44 and opposing side walls 46 and 48. The surfaces of side walls 46 and 48 facing tongue 36 each include an undercut portion 50 which captures a rod 60 in slot 40 when rod 60 is positioned therein as best depicted in FIG. 3.

The inside upper end of tongue 36 may include a downwardly extending inclined surface 52 for directing rod 60 into slot 40 of leg 26. In addition, hanger body 12 may include a rib 54 extending essentially therearound. Rib 54 extends essentially parallel to slot 40 on the outer edge of hanger body 12 to prevent rod 60 from being pushed out of the sides of the hanger. In addition, rib 54 defines a gap 56 on the inner side of leg 26 proximate slot 40 to permit rod 60 to lie against back wall 34 and properly positioned under undercut 50.

As depicted in FIG. 1, rod 60 may include one or more clips 62 slidably received thereon for clamping garments or other objects to hanger 10. Clips 62 may be formed from metal or plastic and may include a spring 64 or other biasing means for holding the jaws of clamp 62 in a closed position.

During manufacture, hanger body 12 is molded separately from hook 20 and rod 60. After molding, hook 20 is inserted and appropriately attached to hanger body 12. It is noted that a plastic hook molded with hanger body 12 may also be used. Rod 60 with clips 62 thereon is then positioned as shown in phantom in FIG. 3 and then moved inwardly and downwardly in the direction of arrow A into slot 40. Inclined surface 52 on tongue 36 guides rod 60 into slot 40 and additional force exerted in the direction of arrow A forces rod 60 in undercut region 50 whereafter resilient tongue 3 biases rod 60 in the slot against the undercut to hold it in place. It is recognized that depending on the type of thermoplastic material used to mold hanger body 12, if an appropriate upward force is applied to rod 60, it can be removed from the slots to permit replacement of clamps 62 or other adjustments to be made.

The garment hanger of the present invention is easy to manufacture and simple to assemble. The rod coupling construction on the legs of the garment hanger permit ready insertion of the rod while insuring an appropriate gripping of the rod in the slot.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

We claim:

1. A garment hanger to support an elongated rod comprising an elongated body having two ends and a supporting portion therebetween, said ends of said body extending downwardly to form a pair of spaced legs each having a rod receiving portion, each said rod receiving portion being defined by a bottom wall, a back wall joined to said bottom wall and forming part of said body, and an upstanding resilient tongue joined to said bottom wall and spaced a predetermined distance from said back wall to define a rod receiving slot, said back wall having an opening therein in alignment with said tongue defined by said bottom wall, a top wall and opposing side walls, the surfaces of said side walls facing said tongue each having an undercut for capturing said rod when inserted in said slot, said tongue biasing said rod in said slot against said undercuts to lock said rod in said rod receiving portions.

2. The garment hanger as claimed in claim 1, wherein each said tongue includes an upper edge having an inside surface facing said back wall, said inside surface being inclined downwardly towards said back wall for directing said rod into said rod receiving slot.

3. The garment hanger as claimed in claim 1, wherein said body includes a rib extending essentially around the periphery thereof, said rib extending across the outer side of each said rod receiving slot to prevent said rod from being moved laterally beyond the ends of said body.

4. The garment hanger as claimed in claim 3, wherein said rib includes a gap at each said rod receiving slot through which said rod extends when seated in said slots.

* * * * *